US007322464B2

(12) United States Patent
Blin

(10) Patent No.: US 7,322,464 B2
(45) Date of Patent: Jan. 29, 2008

(54) FULLY ENCLOSED CARTON AND BLANK

(75) Inventor: Patrick Blin, Chateauroux (FR)

(73) Assignee: MeadWastvaco Packaging Systems, LLC, Glen Allen, VA (US)

( * ) Notice: Subject to any disclaimer, the term of this patent is extended or adjusted under 35 U.S.C. 154(b) by 281 days.

(21) Appl. No.: 11/257,243

(22) Filed: Oct. 24, 2005

(65) Prior Publication Data

US 2006/0096889 A1 May 11, 2006

Related U.S. Application Data

(63) Continuation of application No. PCT/US2004/012327, filed on Apr. 22, 2004.

(30) Foreign Application Priority Data

Apr. 23, 2003 (GB) ..... 0309184.0

(51) Int. Cl.
*B65D 75/00* (2006.01)

(52) U.S. Cl. ..... 206/140; 206/175; 206/193; 206/435

(58) Field of Classification Search ..... 206/784, 206/139, 140, 141, 174, 175, 193, 427, 434, 206/435

See application file for complete search history.

(56) References Cited

U.S. PATENT DOCUMENTS

| | | | | |
|---|---|---|---|---|
| 4,465,181 | A * | 8/1984 | Wood | 206/188 |
| 5,197,598 | A * | 3/1993 | Stout et al. | 206/141 |
| 6,227,367 | B1 | 5/2001 | Harrelson et al. | |
| 2002/0119875 | A1 | 8/2002 | Colby | |

* cited by examiner

*Primary Examiner*—Jacob K. Ackun, Jr.

(57) ABSTRACT

A carton for holding a plurality of articles, comprises a top wall, a base wall, opposed side walls and opposed end walls. A divider structure for separating adjacent articles is formed from at least one of the end walls. The divider structure includes first and second inwardly folded divider panels and an inwardly folded support panel. The divider panels are hinged together and to the opposed side walls respectively while the support panel is hinged to and extending between the respective lower portions of the first and second divider panels.

15 Claims, 3 Drawing Sheets

FULLY ENCLOSED CARTON AND BLANK

This is a continuation of international application No. PCT/US2004/012327, filed Apr. 22, 2004, which is hereby incorporated by reference.

BACKGROUND OF THE INVENTION

The present invention relates to a wraparound carton and blank. More particularly, the invention relates to a wraparound carton and blank for accommodating articles, for example flexible sachets of semi-liquid foodstuffs e.g., fruit juice, having a protruding sachet portion.

Commonly, wraparound carriers are provided with apertures to retain one or more articles. U.S. Pat. No. 4,836,375 (Shuster) illustrates one example.

When flexible articles to be packaged, such as sachets containing semi-liquid foodstuffs, the sachets can potentially be problematic because there is a tendency for such articles to deform, and/or overlap with each other. The present invention seeks to overcome or at least mitigate the problems of the prior art by providing a suitable support structure to reduce the internal movement of articles within the carton and reduce the risk of the outer carton being deformed or, worse, torn.

SUMMARY OF THE INVENTION

A first aspect of the invention provides a carton for holding a plurality of articles which carton comprises a top wall, a base wall, opposed side walls and opposed end walls. A divider structure for separating adjacent articles is formed from at least one of the end walls. The divide structure includes first and second inwardly folded divider panels hinged to one another and to the opposed side walls and an inwardly folded support panel hinged to and extending between the lower portions of the first and second divider panels.

In some embodiments, the side walls converge towards their upper edges.

The top wall may comprise a pair of top wall panels and a locking arrangement for securing the top wall panels together.

A second aspect of the invention provides a blank for forming a carton described in the preceding paragraphs.

BRIEF DESCRIPTIONS OF THE DRAWINGS

Exemplary embodiments of the invention will now be described, by way of example only, with reference to the accompanying drawings in which.

DETAILED DESCRIPTION OF THE PREFERRED EMBODIMENT

Figure 1:
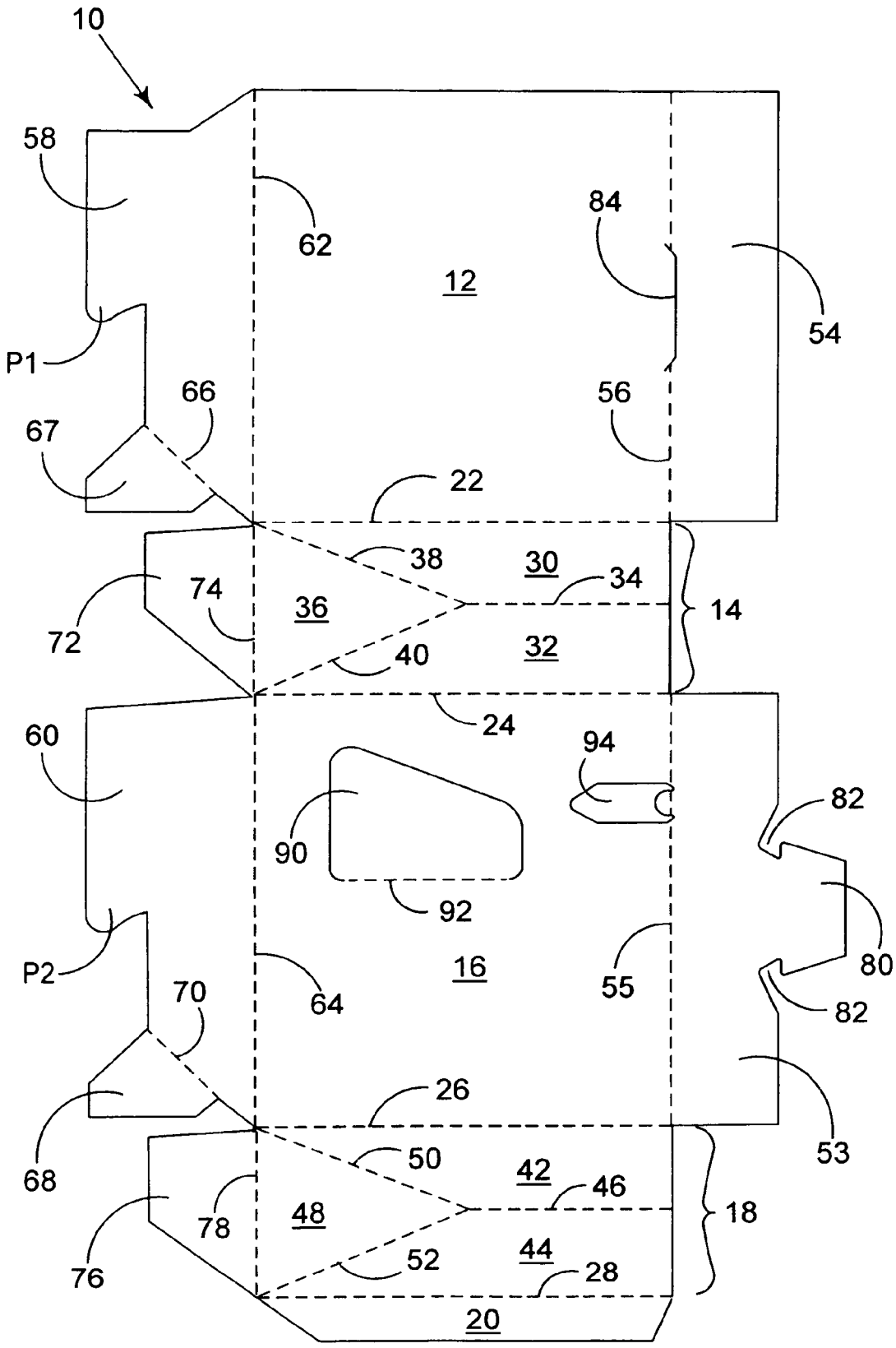
FIG. 1 is a plan view of a blank for forming a carton according to one embodiment of the present invention.
Figure 2:
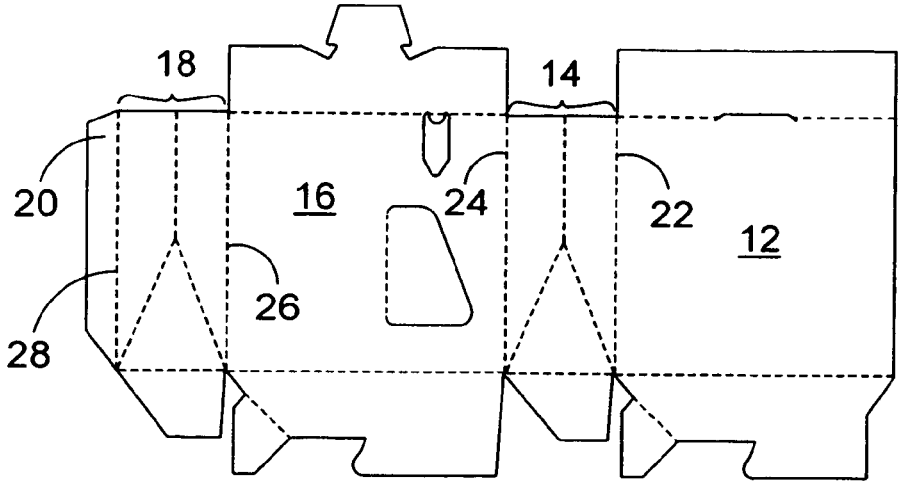
FIGS. 2, 3 and 4 are views of the blank of FIG. 1 during successive stages of carton construction and the loading procedure.
Figure 3:
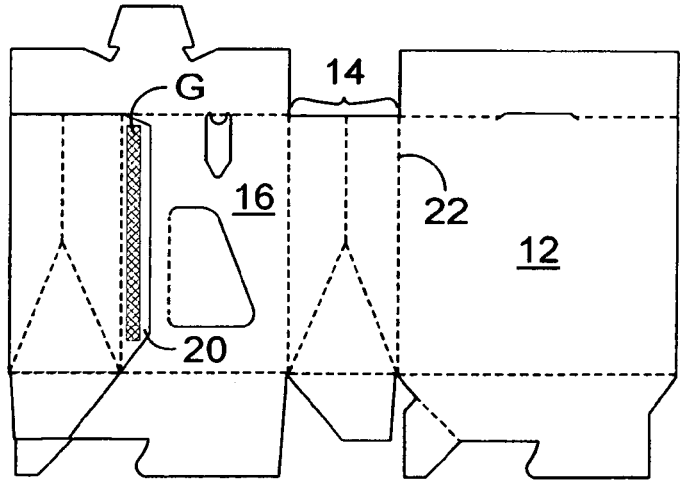

Referring to the drawings and in particular FIG. 1, there is shown a blank 10 formed from paperboard or like foldable sheet material for forming a fully enclosed carton to be used for multiple packaging of articles in an array. The blank comprises a plurality of panels for forming the top, opposed sides and ends and base of the carton.

In this embodiment, there comprises a first side wall panel 12, an end wall panel 14, second side wall panel 16, a second end wall panel 18 and a securing flap 20 hingedly connected one to the next in series along fold lines 22, 24, 26 and 28 respectively.

There further comprises top wall and base wall structures for forming the top and base walls respectively. The top wall structure comprises a first top wall panel 53 hingedly connected to side wall panel 16 along fold line 55 and a second top wall panel 54 hingedly connected to first side wall panel 12 along fold line 56.

The base wall structure is constructed from first base wall panel 58 hingedly connected to first side wall panel 12 along fold line 62 and second base wall panel 60 hingedly connected to the side wall panel 16 along fold line 64. The outer edges of the base wall panels 58 and 60 are provided respectively with portions P1 and P2 that are adapted to be interengaged.

There further comprise engaging flaps 67 and 68 hingedly connected to respective first and second base wall panels 58 and 60 along fold line 66 and 70 respectively. Support flaps are provided by first support flap 72 hingedly connected to end wall panel 14 along fold line 74 and a second support flap 76 hingedly connected to second end wall panel 18 along fold line 78.

The locking arrangement for the carton of the present invention is provided by a locking tab and aperture arrangement whereby there comprises one or more tabs 80 extending from the top wall panel 53. The tab 80 comprises opposed recesses 82 to define a shoulder portion to engage with corresponding edge of an aperture defined in part by cut line 84. The female part of the locking arrangement is, in this invention, provided by the aperture formed when second top wall panel 54 is folded along fold line 56.

There further comprises the divider structure used to separate adjacent articles held within the carton. The divider structure is provided by an arrangement in the end wall structures. Each end wall 14, 18 is provided by inwardly oriented panels which are positioned intermediate adjacent articles. Thus, end wall 14 comprises a first divider panel 30 and a second divider panel 32 hingedly connected together along fold line 34 and to respective first and second side wall panels 12 and 16 along fold lines 22 and 24. In one class of embodiments, there further comprises a support panel 36 hingedly connected to first and second divider panels 30 and 32 along fold lines 38 and 40.

Similarly, end wall 18 comprises a first divider panel 42 and a second divider panel 44 hingedly connected together along fold line 46 and to respective second side wall panel 16 and securing flap 20 along fold lines 26 and 28. There further comprises a support panel 48 hingedly connected to first and second divider panels 42 and 44 along fold lines 50 and 52.

Support panels 36 and 48 are shaped to maintain the divider panels in the desired shape which in this embodiment, is web shaped. Of course, support panels could be formed in a different shape according to the desired shape of the divider, for example arcuate or strophoidal.

There may further comprise one or more display windows 94 in the or each side wall 25 panel 12, 16. Optionally, a transverse partition panel 90 is struck from and hingedly connected to side wall panel 16 along fold line 92 to define a display window. The transverse partition panel 90 is used to separate adjacent arrays of articles.

In order to form the completed carrier in flat collapsed condition from the blank, a series of sequential folding and gluing operations are required and will be described further with reference to FIGS. 2 to 6 of the drawings. The folding and gluing operations can be performed in one or more straight line machines, so that the tray is not required to be rotated or inverted to complete its construction. The folding process is not limited to that described below and can be altered according to particular manufacturing requirements.

Figure 4:
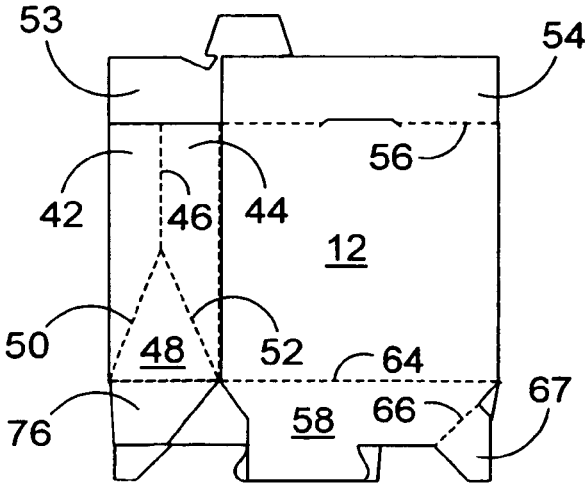
Figure 5:
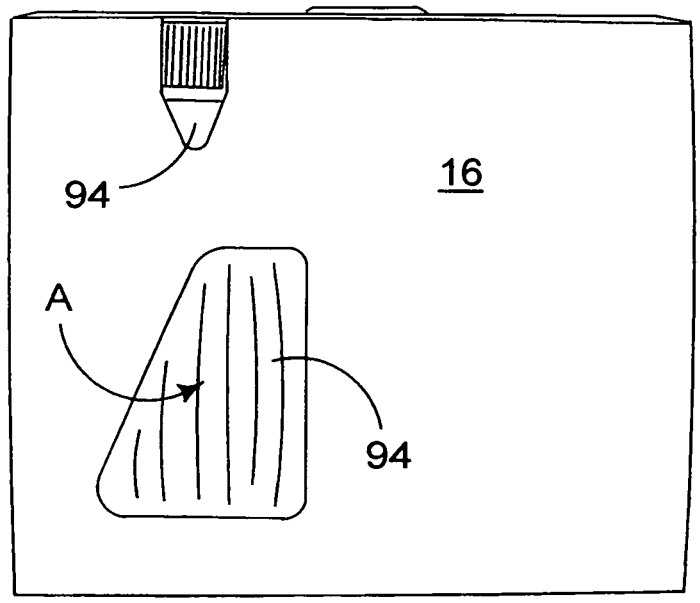
FIG. 5 is a side elevation view of the set up carton.

The first stage of construction is for glue to be applied to the securing flap 20 illustrated by cross hatching and referenced by the letter G. The end wall 18 and securing flap 20 are folded along fold line 26 into face contacting arrangement with side wall panel 16, shown in FIG. 3. Thereafter, side wall panel 12 is folded along fold line 22 to be placed in face contacting arrangement with end wall 14 and is secured to securing flap 20, as shown in FIG. 4. The base wall is part-constructed by folding support flaps 72, 76 inwardly into face contacting relationship with end walls 14, 18. Base wall panels 58, 60 are inwardly folded along fold lines 62, 64 so that engaging flaps 67, 68 are brought in to 15 face contacting relationship with support flaps 72, 76 respectively and are secured together. Thus, the carton is in a flat collapsed condition ready to be supplied to an end user for final construction and loading.

In order to complete construction of the carton, the opposed side wall panels and opposed end wall panels of the carton are folded out of face contacting arrangement along fold lines 22, 24, 26 and 28 to form a tubular structure.

This folding action causes the base wall structure to be automatically formed, whereby support flaps 72, 76 and engaging panels 67, 68 are folded downwardly which in turn causes the first and second base wall panels to be folded outwardly. The protruding portions PI and P2 abut and are then caused to be interengaged in overlapping arrangement.

In those embodiments with a transverse partition panel 90, the panel is folded inwardly along fold line 92 prior to the introduction of articles within the carton.

Articles are loaded by relative vertical movement between the carton and articles, as is well-known and the top wall is formed. The inner top wall panel 54 is folded inwardly along fold line 56 to reveal an aperture formed in part by cut line 84. The outer top wall panel 53 is folded inwardly along fold line 55 and locking tab 80 is folded so as to be inserted into aperture and is engaged therewith. By this means, the inner and outer top walls panels 54 and 53 are secured together in a face contacting relationship.

Figure 6:
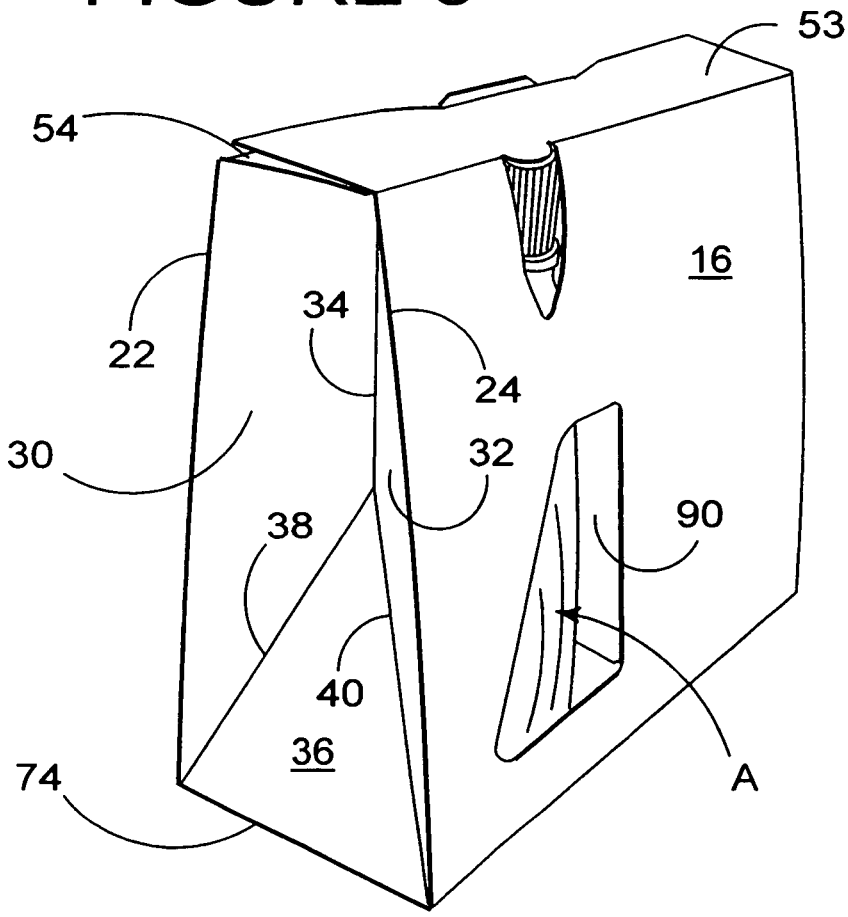
FIG. 6 is a perspective view of the carton formed from the blank of FIG. 1.

The locking action of the tab 80 being inserted into the aperture forces the opposed side wall panels 12 and 16 towards each other which causes the divider to be formed. In this embodiment, the divider is formed by inwardly folding divider panels 30 and 32 and 42 and 44 along fold lines 34 and 46 respectively. In those embodiments with the support panel, the divider panels are also folded along fold lines 38, 40 and 50, 52 to be folded in an angular arrangement with respect to the support panels 36 and 48, as shown in FIG. 6.

The edges of the dividers defined by fold lines 34 and 46 are positioned at the inward point of the divider to separate adjacent articles thereby to improve stability and restrict unwanted movement within the carrier.

The present invention and its preferred embodiment relate to an arrangement for providing a reclosable access structure in a fully enclosed carton. However, it is anticipated that the invention can be applied to a variety of carriers and is not limited to those of the fully enclosed type hereinbefore described and could be used for numerous applications for example a wraparound carton.

It will be recognised that as used herein, directional references such as "top", "base", "end", "side", "inner", "outer", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative top and base closure structures may be used. The carton may accommodate more than one article in different arrays.

The invention claimed is:

1. A carton for holding a plurality of articles comprising a top wall, a base wall, opposed side walls and opposed end walls, wherein a divider structure for separating adjacent articles is formed from at least one of the end walls, the divider structure comprising first and second inwardly folded divider panels hinged to one another and to the opposed side walls respectively, and an inwardly folded support panel hinged to and extending between respective lower portions of the first and second divider panels.

2. A carton as claimed in claim 1 wherein the support panel is hinged to the base wall.

3. A carton as claimed in claim 2 wherein the base wall comprises a pair of support flaps hingedly connected to the end walls respectively, and the support panel is hingedly connected to a respective one of the support flaps.

4. A carton as claimed in claim 3 wherein the base wall further comprises a pair of base wall panels hingedly connected to the side walls respectively.

5. A carton as claimed in claim 1 wherein the support panel is substantially triangular in shape and has a bottom edge and a pair of side edges convergently extending from the bottom edge, the first and second divider panels are hingedly connected to the side edges of the support panel respectively.

6. A carton as claimed in claim 1 wherein the side walls extend from the top wall divergently toward the base wall.

7. A carton as claimed in claim 6 wherein the top wall comprises a pair of top wall panels and a locking arrangement for securing the top wall panels together.

8. A carton as claimed in claim 1 wherein the first and second divider panels are hingedly connected together along a primary fold line that bifurcates into two branch fold lines such that the support panel is defined between the branch fold lines.

9. A carton as claimed in claim 8 wherein the primary fold line bifurcates at an intermediate point between upper and lower edges of the one end wall, the branch fold lines extending downwardly from the intermediate point to the lower edge of the one end wall.

10. A blank for forming a carton for holding a plurality of articles, comprising a pair of opposed side wall panels and a pair of opposed end wall panels, one of the end wall panels comprising first, second and third panel portions for forming a divider structure for separating adjacent articles in a set up carton, the first and second panel portions being hingedly connected together along a primary fold line, the primary fold line bifurcating into a pair of branch fold lines such that the third panel portion is defined between the branch fold lines.

11. A blank as claimed in claim 10 wherein the first and second panel portions of the one end wall panel are hingedly connected to the side wall panels respectively.

12. A blank as claimed in claim 10 further comprising a pair of support flaps hingedly connected to the end wall panels respectively to form a base wall in a set up carton, the third panel portion of the one end wall panel is hingedly connected to a respective one of the support flaps.

13. A blank as claimed in claim 12 further comprising a pair of base wall panels hingedly connected to the side wall panels respectively to form the base wall in cooperation with the support panels.

14. A blank as claimed in claim 10 further comprising a pair of top wall panels hingedly connected to the side wall panels respectively to form a top wall in a set up carton.

15. A blank as claimed in claim 10 wherein the third panel portion of the one end wall panel is substantially triangular in shape and has a bottom edge and a pair of side edges convergently extending from the bottom edge, the first and second panel portions of the one end wall panel are hingedly connected to the side edges of the third panel portion respectively.

* * * * *